US005667014A

United States Patent [19]

Slider et al.

[11] Patent Number: 5,667,014

[45] Date of Patent: Sep. 16, 1997

[54] SELF-REMOVING CHOKE INSERT SYSTEM

[75] Inventors: Mark D. Slider; Gary L. Galle, both of Houston, Tex.

[73] Assignee: ABB Vetco Gray Inc., Houston, Tex.

[21] Appl. No.: 562,617

[22] Filed: Nov. 24, 1995

[51] Int. Cl.[6] ..... E21B 43/013

[52] U.S. Cl. ..... 166/378; 166/348; 166/382

[58] Field of Search ..... 166/348, 380, 166/382, 386, 387, 368, 117.5, 217, 344

[56] References Cited

U.S. PATENT DOCUMENTS

| | | | |
|---|---|---|---|
| 3,589,667 | 6/1971 | Lewis | 166/97.1 X |
| 4,083,409 | 4/1978 | Barrington | 166/320 |
| 4,446,922 | 5/1984 | Bowyer et al. | 166/322 |
| 4,540,053 | 9/1985 | Baugh et al. | 166/348 |
| 4,615,544 | 10/1986 | Baugh | 166/348 X |
| 4,749,046 | 6/1988 | Gano | 166/366 |
| 4,796,698 | 1/1989 | Gano | 166/135 |
| 4,919,459 | 4/1990 | Miller | 285/140 |
| 4,926,898 | 5/1990 | Sampey . | |
| 5,044,432 | 9/1991 | Cunningham et al. | 166/319 |

*Primary Examiner*—Frank Tsay
*Attorney, Agent, or Firm*—James E. Bradley

[57] ABSTRACT

A subsea choke assembly for a well has a resilient closure seal within it which is used for retrieval purposes as well. The closure member is a metal resilient ring having tapered seal surfaces. The tapered seal surfaces locate between the choke body housing and the choke body bonnet. When securing the bonnet to the housing, the resiliency of the closure seal must be overcome, as well as the force required to insert an inner seal into its sealing surface within the bore. When the bonnet is released, the closure seal has sufficient spring force to push itself upward from the housing. In addition, it pushes the bonnet upward from closure seal. The choke body moves upward in unison with the bonnet, freeing the inner seal from its sealing surface.

16 Claims, 3 Drawing Sheets

SELF-REMOVING CHOKE INSERT SYSTEM

BACKGROUND OF THE INVENTION

1. Field of the Invention

This invention relates in general to well production systems, and in particular to a choke utilized with a subsea tree assembly.

2. Description of the Prior Art

In oil or gas well, a christmas tree will be mounted to a wellhead at the upper end of the well. The tree has outlets for the flow of production fluid. A choke will be mounted to the tree in a production passage. The choke restricts the fluid flow to a selected level to maintain adequate formation pressure.

Typically, a choke has a housing which has a bore. The bore is in communication with the tree production flow passage. The choke body fits inside the housing in a position where the production flow is required to flow through a portion of the choke body. The choke body is secured by a bonnet. Particularly for high pressure chokes, metal seals are used, with one of the seals being an inner seal. The inner seal, also referred to as a "bean" seal, surrounds the choke body and seals to the bore of the choke housing. A closure seal locates between the faces of the bonnet and choke housing. A recess or counterbore is located in the bore and joins the seal surface for the inner seal.

The choke body requires considerable force to insert and withdraw because of the metal inner seal. Hydraulically operated clamps are utilized in the case of high pressure subsea chokes for clamping the bonnet to the choke housing to force the inner seal from the counterbore area into the seal area. In high pressure chokes, it can be a difficult task to pull the choke body from the choke housing bore. Even though the clamps are released, the radially preloaded inner seal provides substantial frictional force, requiring a mechanical device to pull the choke body. This is particularly a problem in the case of a subsea well in deep water. An expensive piece of remotely operated equipment may be required to pull the choke.

SUMMARY OF THE INVENTION

In this invention, the choke is provided with a special closure seal that has a high spring force. The closure seal seals against at least one tapered seal surface. The tapered seal surface creates an axial outwardly directed force component when the seal is deflected into sealing engagement. The axial force component is selected to be equal or greater than the axial force required to pull the inner seal from the inner seal surface into the counterbore. Once the clamp is loosened, the preload on the closure seal pushes the closure seal outward relative to the tapered seal surface. The bonnet in turn moves outward relative to the closure seal, pulling the choke body outward.

The axial distance of movement of the bonnet relative to the housing is equal or greater than the distance that the inner seal must travel to reach the counterbore area. Consequently, the resiliency of the closure seal will move the choke body to a point where the inner seal is the relieved area. This frees the choke body to allow it to be readily withdrawn from the bore of the choke housing.

DETAILED DESCRIPTION OF THE PREFERRED EMBODIMENT

Figure 1A:
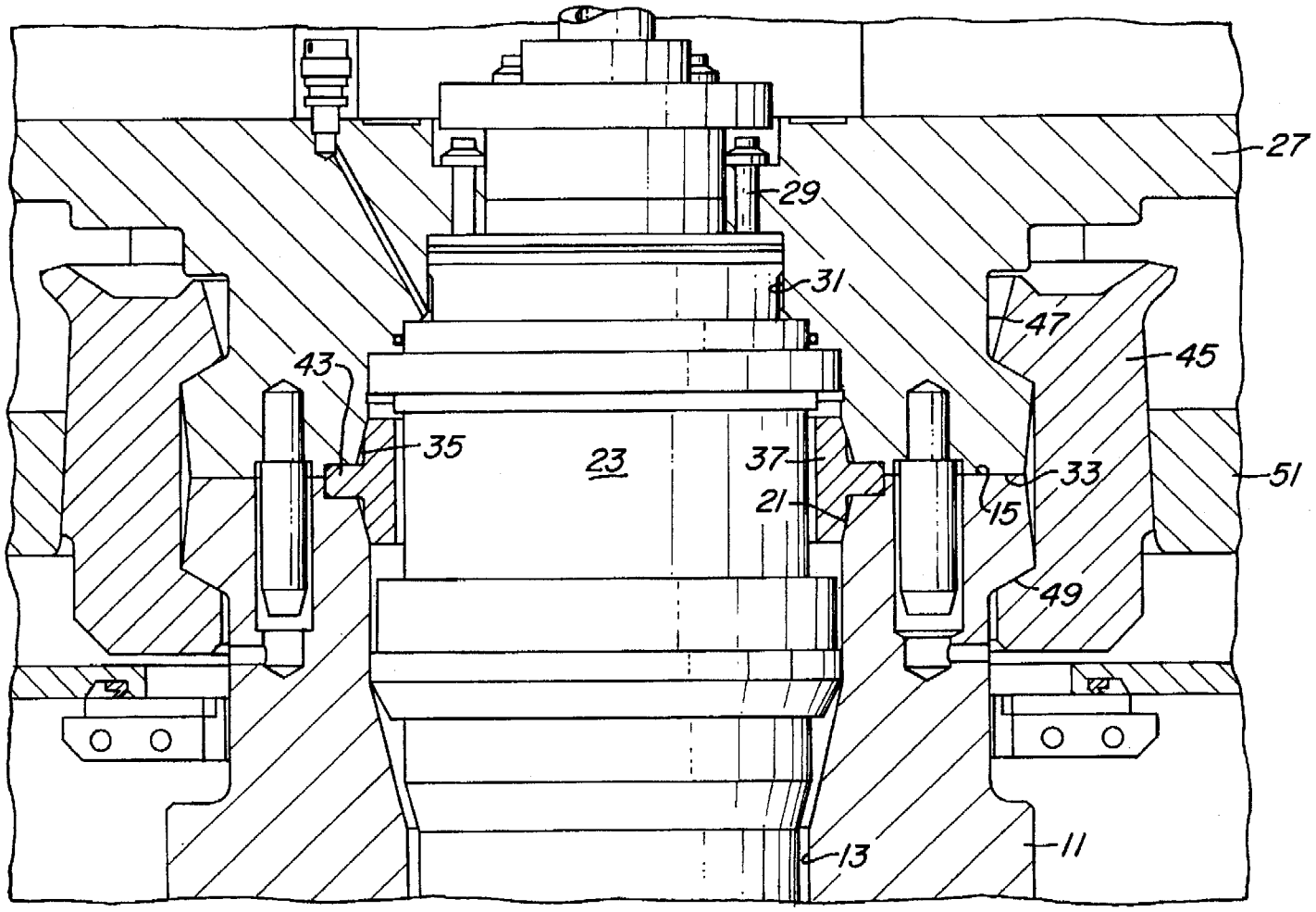
FIGS. 1A and 1B comprise a vertical sectional view of a portion of a choke assembly constructed in accordance with this invention.
Figure 1B:
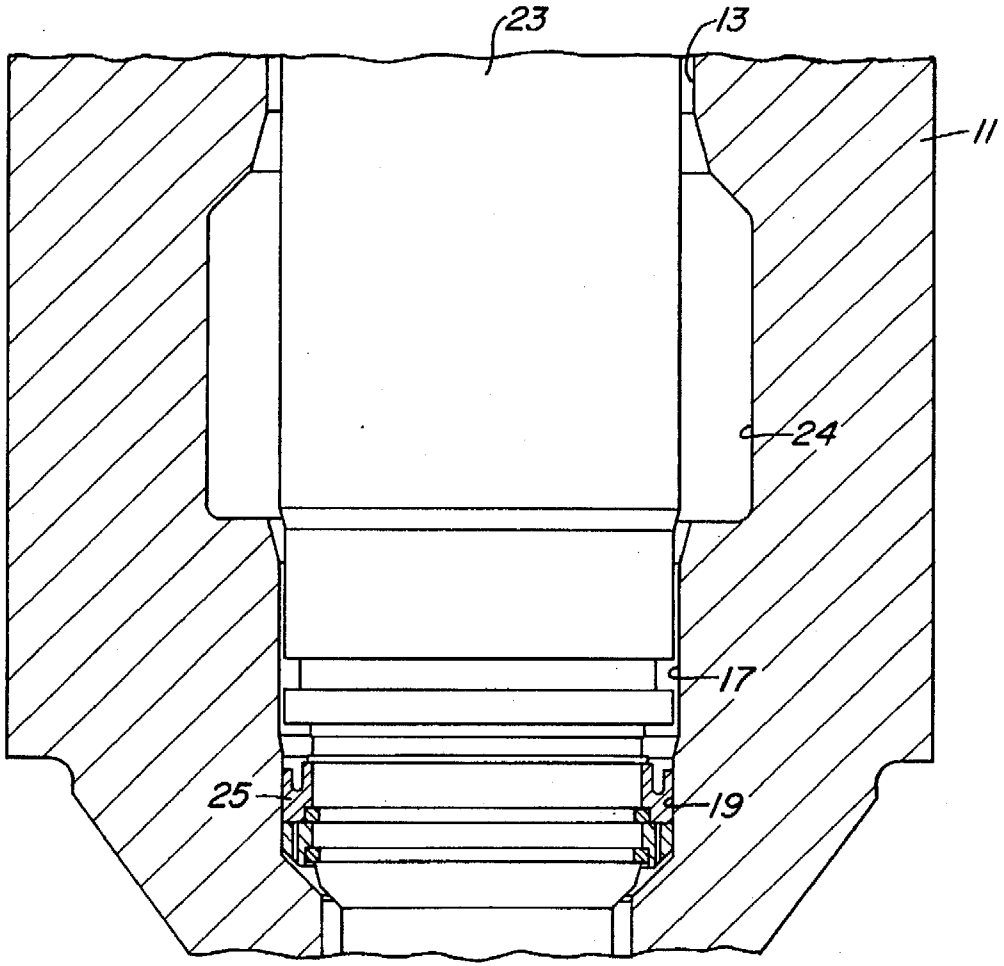

Referring to FIG. 1A, the choke assembly includes a choke housing 11. Housing 11 will be coupled to a production tree, particularly a subsea tree. Housing 11 has a bore 13 which terminates on its upper end with a rim or face 15. The term "upper" is used herein for convenience only as the choke assembly may be oriented horizontal rather than vertical as shown. Referring to FIG. 1B, a relieved area or a counterbore 17 is located within bore 13. A cylindrical inner seal surface 19 joins counterbore 17. Inner seal surface 19 is of slightly lesser diameter than counterbore 17. A tapered or conical closure seal surface 21 is located at the intersection of face 15 and bore 13, as shown in FIG. 1A.

An insert member or choke which includes a choke body 23 locates within bore 13. The choke is conventional and is used to restrict the flow of fluid through the production flow line. Production fluid flows through a passage (not shown) in housing 11, and from a flow area 24 through passages (not shown) in choke body 23. The restricted flow passes out the lower end of choke body 23. Choke body 23 is cylindrical and has an inner or bean seal 25 near its lower end, shown in FIG. 1B. In the embodiment shown, inner seal 25 is conventional and in the shape of a "U", having radially spaced apart legs which engage the seal surface 19 and choke body 23. The seal legs have protruding seal bands 26, 28 adjacent their upper ends. Inner seal 25 is metal and has an undeflected outer diameter at outer band 26 that is greater than the inner diameter of seal surface 19. The inner diameter of counterbore 17 is slightly greater than the undeflected outer diameter of seal 25 at band 26, so that no radial preload force on seal 25 exists while seal 25 is within counterbore 17. When installed against seal surface 19, band 26 deflects radially inward, creating a radial preload force. A considerable axial force is required to push seal 25 to the sealing position, shown in FIG. 1B, as well as to retrieve seal 25.

Referring again to FIG. 1A, a closure member or bonnet 27 fits over housing 11. A plurality of bolts 29 extend into choke body 23 to rigidly secure choke body 23 to bonnet 27 within bore 31 of bonnet 27. Bonnet 27 has a face 33 that is perpendicular to the axis of bore 31 and will be closely spaced to face 15 when secured as shown in FIG. 1A. Bonnet 27 also has a closure seal surface 35 located at the intersection of face 33 and bore 31. Closure seal surface 35 is conical and at the same angle as closure seal surface 21 relative to the axis.

Figure 2:
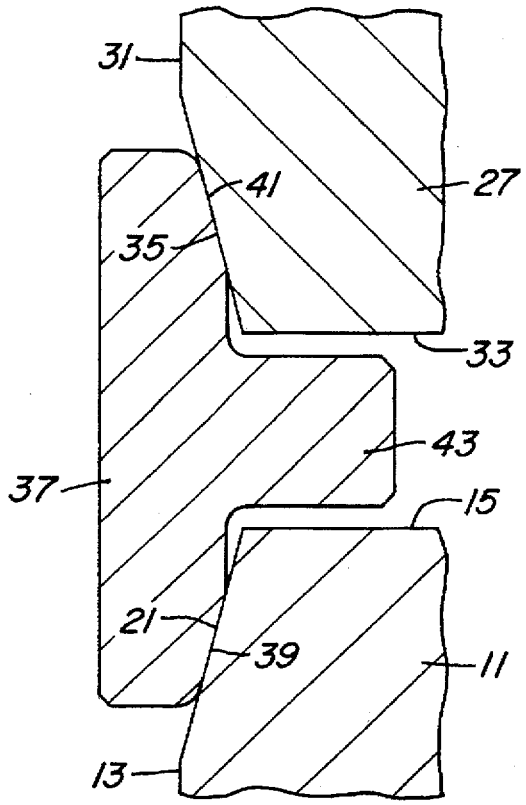
FIG. 2 is an enlarged sectional view of the closure seal utilized with the choke assembly of FIG. 1, and showing the bonnet in a released position.

A closure seal 37 sealingly engages closure seal surfaces 21 and 35. Closure seal 37, shown in FIG. 2, is a resilient metal member. It has lower and upper tapered surfaces 39, 41 on its outer diameter. A rib 43 extends radially outward between the lower and upper tapered surfaces 39, 41 and locates within recesses in faces 15, 33. When bonnet 27 is fully secured to housing 11, faces 15, 33 will engage rib 43, but will not touch each other. Tapered surfaces 39, 41 are formed at the same angles as the closure seal surfaces 21, 35. Closure seal 37 is dimensioned so that it will sealingly engage the tapered surfaces 21, 35, and will require an axial force on bonnet 27 to deflect seal 37 into full sealing engagement. The amount of deflection does not exceed the yield strength of the seal 27, thus it will not be permanently deformed when fully installed.

The spring force of seal 37 is selected so that when bonnet 27 is unfastened from housing 11, seal 37 will move upward relative to housing 11 due to lower tapered surface 39 resuming its undeflected condition shown in FIG. 2. Similarly, bonnet 27 will move upward relative to closure seal 37, to the position shown in FIG. 2, due to upper tapered surface 39 resuming its undeflected condition. Closure seal 37 has sufficient spring force so as to pull choke body 23 upward, causing band 26 of inner seal 25 to move into the counterbore 17 to release its frictional force. The axial force generated by the preload on seal 37 is also sufficient to lift the weight of choke body 23 and bonnet 27.

The angle of tapered surfaces 39, 41, as well as the surfaces 21, 35, is within the range of 10 to 15 degrees relative to the axis of bore 13. In the preferred embodiment, the angle is approximately 13 degrees. The material must have adequate elasticity and must not undergo permanent deformation when bonnet 27 is secured to housing 11. In the preferred embodiment the yield strength of the material in the range from 130,000 to 140,000 psi, and is preferably 130,000. The modules of elasticity in the range from 15,000,000 to 30,000,000, and preferably about 16,000,000. One suitable material is titanium alloyed with beryllium and copper. Another material believed suitable is Inconel, a high nickel steel alloy. In one choke assembly, the inner diameter of closure seal 37 is approximately 8.4 inches and the amount of spring force generated in the axial direction by closure seal 37 when preloaded to the sealed position of FIG. 1 is about 800 to 1200 lbs.

Referring again to FIG. 1, the means for fastening bonnet 27 to housing 11 is conventional. In the embodiment shown, which is a subsea remote installation, a plurality of dogs 45 are spaced around face 33 of bonnet 27. Dogs 45 have upper ends which engage an annular recess 47 in bonnet 27. The lower ends are adapted to engage an annular shoulder 49 formed on housing 11. Dogs 45 are pushed to the lower position by an actuator cam ring 51. Ring 51 is moved up and down by hydraulic cylinders (not shown).

During installation, choke body 23 will first be secured to bonnet 27 by fasteners 29. Closure seal 37 will be carried by choke body 23, preferably in partial engagement with closure seal surface 35. Seal 25 will be mounted to choke body 23. Actuator ring 51 will be in an upper position, forcing the lower ends of dogs 45 radially outward. An ROV (remote operated vehicle) will stab choke 23 into bore 13. The downward movement will cease once inner seal 25 reaches the lower end of counterbore 17. Choke body 23 will not at this time advance further downward because of the interference of seal 25 with inner seal surface 19. Closure seal 37 will in partial engagement with closure seal surface 21, generally in the position shown in FIG. 2.

Figure 3:
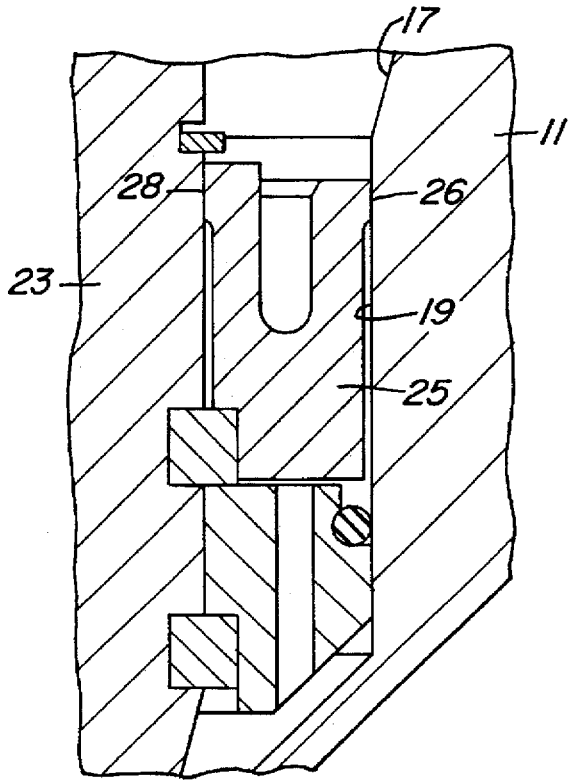
FIG. 3 is an enlarged sectional view of the inner seal utilized with the choke assembly of FIG. 1.

The operator then applies hydraulic pressure to push actuator ring 51 downward. This forces the lower ends of dogs 45 inward. The tapered flanges draw the bonnet 27 into tight engagement with housing 11. Choke body 23 will move further downward in housing 11 until faces 15, 33 contact rib 43. Tapered surfaces 39, 41 will move into tight sealing engagement with seal surfaces 21, 35. Inner seal 25 will move into sealing engagement with seal surface 19 as shown in FIG. 3. Choke body 23 will be axially preloaded due to the force required to overcome the resiliency of closure seal 37. Inner seal 25 will be radially preloaded between choke body 23 and housing seal surface 19. Production fluid will flow through choke body 23 which restricts the flow in a conventional manner.

To remove choke body 23, the operator will supply hydraulic fluid pressure to move actuator ring 51 upward. Ring 51 will pivot the dogs 45 inward into recess 47, freeing the lower ends from shoulder 49. Once this occurs, the axial component of the preload force on closure seal 37 will cause closure seal 37 to spring or move upward. Similarly, tapered surface 41 will cause bonnet 27 to slide upward relative to closure seal 37 to the position shown in FIG. 2. Choke body 23 will move upward with bonnet 27, drawing inner seal 25 upward. Because tapered surfaces 39, 41 are identical to each other, the axial distance that seal 37 moves relative to housing 11 is the same as the axial distance that bonnet 27 moves relative to seal 37.

The axial distance that inner seal 25 moves upward is equal to the sum of the distance that closure seal 37 moves upward relative to housing 11 plus the distance that bonnet 27 moves upward relative to closure seal 37. This distance is sufficient to place band 26 of seal 25 in counterbore 17, freeing the radial preload. At this point, seal 25 exerts no frictional force tending to hold body 23 within bore 13. Choke body 23 and bonnet 27 can then be lifted from housing 11.

The invention has significant advantages. By constructing the closure seal with sufficient resiliency and strength, it will move the inner seal to an upper position to move it into a relieved area. This avoids the need for a special purpose tool with sufficient force to pull the inner seal from its seat while it is under radial compression.

While the invention is shown in only one of its form, it should be apparent to those skilled in the art that it is not so limited but is susceptible to various changes without departing from the scope of the invention.

We claim:

1. A well subassembly, comprising in combination:

a housing containing a bore having an axis which terminates at an outer face;

an annular inner seal surface in the bore;

a counterbore of larger diameter than the inner seal surface, joining and located outward of the inner seal surface along the axis;

a first annular closure seal surface at an intersection of the bore and the face;

an insert member which inserts into the bore;

an inner seal carried by the insert member which engages the inner seal surface;

a closure member which carries the insert member such that outward movement of the closure member causes simultaneous outward movement of the insert member;

a second annular closure seal surface formed on the closure member;

a resilient metal closure seal having mating surfaces which engage the closure seal surfaces of the housing and closure member, respectively;

at least one of the closure seal surfaces being tapered;

fastening means for securing the closure member to the housing and preloading one of the mating surfaces of the closure seal against the closure seal surface which is tapered; and the closure seal being capable of self-releasing from being preloaded when the fastening means is released and having a sufficient spring force to cause the bonnet and insert member to move outward relative to the housing, thereby moving the inner seal from the inner seal surface into the counterbore, freeing the insert member for retrieval from the housing.

2. The well subassembly according to claim 1, wherein both of the closure seal surfaces and both of the mating surfaces are tapered; and wherein the spring force of the closure seal causes the closure seal to move outward relative to the housing and causes the closure member to move outward relative to the closure seal.

3. A well subassembly, comprising in combination:

a housing containing a bore having an axis which terminates at an outer face;

an annular inner seal surface in the bore;

a counterbore of larger diameter than the inner seal surface joining and located outward of the inner seal surface along the axis;

a tapered annular closure seal surface at an intersection of the bore and the face;

an insert member which inserts into the bore;

an inner seal carried by the insert member which engages the inner seal surface;

a closure member which has a bore terminating at a face, the insert member extending into the bore of the closure member and being connected to the closure member such that outward movement of the closure member causes simultaneous outward movement of the insert member;

a tapered annular closure seal surface located at the intersection of the bore and the face of the closure member;

a resilient metal closure seal having inner and outer tapered surfaces which engage the closure seal surfaces of the housing and closure member, respectively;

fastening means for securing the closure member to the housing and preloading the tapered surfaces of the closure seal against the closure seal surfaces of the housing and closure member; and the closure seal being capable of self-releasing from being preloaded against the tapered surfaces when the fastening means is released, and having a sufficient spring force to move the closure member and insert member outward relative to the housing, thereby moving the inner seal from the inner seal surface into the counterbore, freeing the insert member for retrieval from the housing.

4. The well subassembly according to claim 3, wherein:

the closure seal has a radially extending rib extending away from the bores.

5. The well subassembly according to claim 3, wherein the tapered surfaces of the seal intersect the axis of the bore at angles in the range from 10 to 15 degrees.

6. The well subassembly according to claim 3, wherein an axial force in the range from 800 to 1200 pounds is required to move the closure member and the insert member outward relative to the housing when the fastening means is released.

7. The well subassembly according to claim 3, wherein the closure seal is formed of a metal which has a modules of elasticity in the range from 15,000,000 to 30,000,000.

8. A well choke, comprising in combination:

a housing containing a bore having an axis, the bore terminating at first face;

an annular inner seal surface in the bore;

a counterbore of larger diameter than the inner seal surface joining and located outward of the inner seal surface;

a tapered annular closure seal surface at an intersection of the bore and the first face;

a choke body which inserts into the bore;

an inner seal carried by the choke body which engages the inner seal surface;

a bonnet which has a bore terminating at a second face, the choke body extending into the bore of the bonnet;

connection means for rigidly connecting the choke body to the bonnet;

a tapered annular closure seal surface located at the intersection of the bore and the second face;

a resilient metal closure seal having mating tapered surfaces which engage the closure seal surfaces of the housing and bonnet, respectively;

fastening means for securing the bonnet to the housing and preloading the tapered surfaces of the closure seal against the closure seal surfaces of the housing and bonnet; and the closure seal being capable of self-releasing from being preloaded against the tapered surfaces when the fastening means is released, and having a sufficient spring force to move the bonnet and choke body outward relative to the housing, thereby moving the inner seal from the inner seal surface into the counterbore, freeing the choke body for retrieval from the housing.

9. The well choke according to claim 8, wherein:

the closure seal has a radially extending rib extending away from the bores.

10. The well choke according to claim 8, wherein the tapered surfaces of the closure seal intersect the axis of the bore at angles in the range from 10 to 15 degrees.

11. The well choke according to claim 8, wherein an axial force in the range from 800 to 1200 pounds is required to move the closure member and insert member upward relative to the housing when the fastening means is released.

12. The well choke according to claim 8, wherein the closure seal is formed of a metal which has a modules of elasticity in the range from 15,000,000 to 30,000,000.

13. The well choke according to claim 8, wherein:

the inner seal moves a first axial distance when moving from the inner seal surface to the counterbore; and when the fastening means is released, the closure seal moves relative to the face of the housing one-half of the first axial distance; and the bonnet moves relative to the closure seal one-half of the first axial distance.

14. A method for installing and removing an insert member from a housing having a bore which terminates at an outer face, an annular inner seal surface in the bore, a counterbore of larger diameter than the inner seal surface, joining and located outward of the inner seal surface, an inner seal carried by the insert member which engages the inner seal surface, and a closure member, the method comprising:

providing a first annular closure seal surface at an intersection of the bore and the face of the housing and a second annular closure seal surface on the closure member, and tapering at least one of the closure seal surfaces;

providing a resilient metal closure seal having mating surfaces and a selected spring force;

securing the insert member to the closure member for axial movement therewith;

placing the insert member in the bore of the housing with the inner seal located in the counterbore and the mating surfaces of the closure seal in contact with the closure seal surfaces of the housing and the closure member, and securing the closure member to the housing, causing the insert member to advance into the bore, the inner seal to engage the inner seal surface, and one of the mating surfaces of the closure seal to preload against the closure seal surface which is tapered; then, to remove the insert member, releasing the closure member from the housing, the selected spring force of the closure seal causing the closure member and insert member to move outward relative to the housing, moving the inner seal from the inner seal surface into the counterbore; then retrieving the insert member from the bore of the housing.

15. The method according to claim 14, wherein the steps of providing the closure seal surfaces comprises tapering both of the closure seal surfaces.

16. The method according to claim 14, wherein the closure seal exerts an axial force in the range from 2000 to 3000 pounds to move the closure member and insert member outward relative to the housing after the closure member is released.

* * * * *